US010907240B2

(12) United States Patent
Watanabe et al.

(10) Patent No.: US 10,907,240 B2
(45) Date of Patent: Feb. 2, 2021

(54) IRON-BASED SINTERED ALLOY AND METHOD FOR PRODUCING SAME

(71) Applicant: THE JAPAN STEEL WORKS, LTD., Tokyo (JP)

(72) Inventors: Yusuke Watanabe, Hiroshima (JP); Kakeru Kusada, Hiroshima (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 194 days.

(21) Appl. No.: 16/301,790

(22) PCT Filed: May 10, 2017

(86) PCT No.: PCT/JP2017/017739
§ 371 (c)(1),
(2) Date: Nov. 15, 2018

(87) PCT Pub. No.: WO2017/199819
PCT Pub. Date: Nov. 23, 2017

(65) Prior Publication Data

US 2019/0153573 A1 May 23, 2019

(30) Foreign Application Priority Data

May 19, 2016 (JP) ..... 2016-100817

(51) Int. Cl.
*C22C 38/00* (2006.01)
*C22C 33/02* (2006.01)
(Continued)

(52) U.S. Cl.
CPC ..... *C22C 33/0228* (2013.01); *C21D 6/004* (2013.01); *C22C 33/0285* (2013.01);
(Continued)

(58) Field of Classification Search
CPC ..... C21D 6/004; C21D 33/0292; C22C 33/0228; C22C 33/0285
See application file for complete search history.

(56) References Cited

U.S. PATENT DOCUMENTS 3,369,891 A 2/1968 Tarkan et al.
2005/0132842 A1 6/2005 Kawata et al.
(Continued)

FOREIGN PATENT DOCUMENTS

CN 103480849 A 1/2014
CN 105970064 A 9/2016
(Continued)

OTHER PUBLICATIONS

Communication dated Sep. 26, 2019, issued by the European Patent Office in counterpart European Application No. 17799244.3.
(Continued)

*Primary Examiner* — Scott R Kastler
(74) *Attorney, Agent, or Firm* — Sughrue Mion, PLLC

(57) ABSTRACT

Produced is an iron-based sintered alloy in which hard particles derived from a titanium carbide powder are dispersed in the form of islands in a matrix comprising a two phase structure of austenite+martensite. The iron-based sintered alloy is obtained by mixing the titanium carbide powder, a Cr powder, a Mo powder, a Co powder, a Fe powder and a powder of Al, Ti or Nb so as to obtain a mixed powder that contains, in terms of mass %, 20-35% of titanium carbide, 3.0-12.0% of Cr, 3.0-8.0% of Mo, 8.0-23% of Ni, 0.6-4.5% of Co and 0.6-1.0% of Al, Ti or Nb, with the balance Fe, and then subjecting the mixed powder to cold isostatic compression molding, vacuum sintering and solution treatment.

6 Claims, 4 Drawing Sheets

(51) Int. Cl.

| | |
|---|---|
| ***C21D 6/00*** | (2006.01) |
| ***C22C 38/44*** | (2006.01) |
| ***C22C 38/50*** | (2006.01) |
| ***C22C 38/52*** | (2006.01) |
| *B26D 1/00* | (2006.01) |
| *B22F 5/00* | (2006.01) |
| *B26F 1/44* | (2006.01) |
| *B21C 25/02* | (2006.01) |

(52) U.S. Cl.

CPC ..... *C22C 33/0292* (2013.01); *C22C 38/44* (2013.01); *C22C 38/50* (2013.01); *C22C 38/52* (2013.01); *B21C 25/025* (2013.01); *B22F 2005/001* (2013.01); *B22F 2998/10* (2013.01); *B22F 2999/00* (2013.01); *B26D 1/00* (2013.01); *B26D 2001/002* (2013.01); *B26F 1/44* (2013.01); *B26F 2001/4436* (2013.01); *C21D 2211/001* (2013.01); *C21D 2211/008* (2013.01)

(56) References Cited

U.S. PATENT DOCUMENTS

| | | | |
|---|---|---|---|
| 2006/0207386 | A1 | 9/2006 | Kawata et al. |
| 2007/0169585 | A1 | 7/2007 | Kawata et al. |
| 2012/0015204 | A1 | 1/2012 | McCabe et al. |
| 2019/0153573 | A1* | 5/2019 | Watanabe ..... C22C 38/44 |

FOREIGN PATENT DOCUMENTS

| | | | |
|---|---|---|---|
| DE | 2061485 | A1 | 4/1972 |
| GB | 1165491 | A | 10/1969 |
| GB | 1293610 | A | 10/1972 |
| GB | 1332061 | A | 10/1973 |
| JP | 8-253845 | A | 10/1996 |
| JP | 11-50104 | A | 2/1999 |
| JP | 11-92870 | A | 4/1999 |
| JP | 2000-256799 | A | 9/2000 |
| JP | 2000-273503 | A | 10/2000 |
| JP | 2005-154796 | A | 6/2005 |
| JP | 2013-541633 | A | 11/2013 |

OTHER PUBLICATIONS

Communication dated May 6, 2020, from the State Intellectual Property Office of People's Republic of China in counterpart Application No. 201780030040.2.

International Search Report (PCT/ISA/210) dated Jun. 6, 2017 issued by the International Searching Authority in International Application No. PCT/JP2017/017739.

Written Opinion (PCT/ISA/237) dated Jun. 6, 2017 issued by the International Searching Authority in International Application No. PCT/JP2017/017739.

* cited by examiner

Analysis Portion A

Analysis Portion B

IRON-BASED SINTERED ALLOY AND METHOD FOR PRODUCING SAME

TECHNICAL FIELD

The present invention relates to an iron-based sintered alloy to be used in sliding components such as a die material and a cutter blade material for a pelletizer of a resin extruder, and a method for producing the same.

BACKGROUND ART

Since a cutter blade or the like for a pelletizer of a resin extruder is severely worn under a corrosive environment, excellent corrosion resistance and wear resistance are required. Also, a tool material for use in the cutter blade or the like for a resin extruder desirably has not only excellent corrosion resistance and wear resistance but also machinability for processing the material into the cutter blade or the like.

To such a request, for example, Patent Document 1 proposes a highly corrosion-resistant carbide-dispersed material in which carbides of Ti and Mo are dispersed in a matrix, and the carbide-dispersed material contains, in terms of weight ratio, Ti: 18.3 to 24%, Mo: 2.8 to 6.6%, C: 4.7 to 7% as carbides and contains Cr: 7.5 to 10%, Ni: 4.5 to 6.5%, Co: 1.5 to 4.5%, and 0.6 to 1% of one or more of Al, Ti, and Nb as the matrix, the balance being Fe and unavoidable impurities. The highly corrosion-resistant carbide-dispersed material is used as a tool steel such as a cutter blade for a resin extruder, is machinable, and has excellent wear resistance and corrosion resistance. Mo in the composition is added in the form of a carbide or a compound such as $Mo_2C$, whereby a solid solution carbide is formed with Ti to improve wettability between TiC and the matrix and it is said that Cr has an effect of improving corrosion resistance, Ni has an effect of improving toughness, and Co has an effect of improving transverse rupture strength.

Patent Document 2 proposes a sintered steel in which hard particles containing TiC are dispersed in an amount of 20 to 40% by mass in a matrix containing Fe or an Fe alloy as a main component, wherein the hard particle containing TiC is necessarily present on an arbitrary line segment having a length of 20 mm in an optical microscopic photograph of 400 magnifications which takes a steel surface thereof and the matrix contains, in terms of % by mass, Ni: 3 to 20%, Co: 2 to 40%, Mo: 2 to 15%, Al: 0.2 to 2.0%, Ti: 0.2 to 3.0%, Cu: 0.2 to 5.0%, and further Cr: 3 to 20%. The sintered steel is said to be excellent in wear resistance since hard particles are homogeneously dispersed therein.

Patent Document 3 proposes a stainless steel alloy excellent in machinability, corrosion resistance, and wear resistance, which is derived from martensite-based stainless steel (AISI 420, 440C). That is, there is proposed a stainless steel alloy composition, including: rounded carbides in a matrix comprising at least one selected from the group consisting of ferrite and martensite, the rounded carbides having particle sizes of less than 5 microns, comprising a first quantity of niobium-containing carbide and a second quantity of chromium carbide, and being substantially free of large, irregularly-shaped carbides; and free chromium in the matrix. In the composition, the carbide contains both of the niobium-containing carbide and chromium carbide and the total of the components is 4 to about 25% by weight.

Patent Document 4 proposes a wear-resistant sintered alloy including, in terms of weight ratio, Mo: 5.26 to 28.47%, Co: 1.15 to 19.2%, Cr: 0.25 to 6.6%, Si: 0.05 to 2.0%, V: 0.03 to 0.9%, W: 0.2 to 2.4%, and C: 0.43 to 1.56%, the balance being Fe and unavoidable impurities; in which into a matrix structure composed of a bainite phase or a mixed phase of bainite and martensite, a Co-based hard phase in which a precipitate mainly composed of Mo silicate is integrally precipitated in a Co-based alloy matrix is dispersed in an amount of 5 to 40% and an Fe-based hard phase in which particulate Cr carbide, Mo carbide, V carbide, and W carbide are precipitated in an Fe-based alloy matrix is dispersed in an amount of 5 to 30%. Since the wear-resistant sintered alloy has a structure in which a hard phase is dispersed only in a matrix of a bainite single phase or a mixed phase of bainite and martensite, the alloy is said to be excellent in wear resistance.

BACKGROUND ART CITATION LIST

Patent Literature

Patent Document 1: JP-A-11-92870
Patent Document 2: JP-A-2000-273503
Patent Document 3: JP-T-2013-541633
Patent Document 4: JP-A-2005-154796

SUMMARY OF THE INVENTION

Technical Problems

In the highly corrosion-resistant carbide-dispersed material described in Patent Document 1, data of hardness, transverse rupture strength, and a corrosion test are described but data of a wear test are not described. Meanwhile, in the sintered steel described in Patent Document 2, friction loss of the counterpart material is not described in the data of a wear test. Moreover, in the stainless steel alloy described in Patent Document 3 or the wear-resistant sintered alloy described in Patent Document 4, the hard particles dispersed in the matrix do not contain titanium carbide. In general, there are not many examples in which a component of main hard particles in iron-based alloys is titanium carbide and particularly, there are few examples of a wear test in which material quality is the same. Meanwhile, a variety of materials have been utilized as resin materials to be used in a resin extruder and its application range has been extended. Thus, higher corrosion resistance, wear resistance, machinability, or mechanical strength has been required for a tool material for use in a cutter blade or the like for a pelletizer.

In view of such conventional problems, an object of the present invention is to provide an iron-based sintered alloy containing hard particles dispersed therein, which is excellent in machinability, corrosion resistance, and wear resistance using titanium carbide having excellent wear resistance and a small coefficient of friction as a main hard particle and particularly is used in sliding components such as a die material and a cutter blade material for a pelletizer and which is capable of preventing wear of a counterpart material, and a method for producing the same.

Solution to Problems

The present inventors have found that, in an iron-based sintered alloy which is used in sliding components such as a die material and a cutter blade material for a pelletizer, hard particles dispersed therein being mainly titanium carbide, it is preferred that the matrix has a two-phase structure of austenite and martensite is preferred. Also, they have obtained findings that the composition of the matrix of such an iron-based sintered alloy is a composition belonging to a region of austenite+martensite (A+M) in Schaeffler's diagram. Thus, they have accomplished the present invention.

The method for producing an iron-based sintered alloy according to the present invention includes mixing a titanium carbide powder, a Cr powder, a Mo powder, a Ni powder, a Co powder, a Fe powder, and a powder of any one of Al, Ti, and Nb and subjecting a resulting mixed powder thereof containing, in terms of % by mass, titanium carbide: 20% to 35%, Cr: 3.0% to 12.0%, Mo: 3.0% to 8.0%, Ni: 8.0% to 23%, Co: 0.6% to 4.5%, and any one of Al, Ti or Nb: 0.6% to 1.0%, with the balance Fe, to cold isostatic pressing molding, vacuum sintering, and a solution treatment, to produce an iron-based sintered alloy in which hard particles derived from the titanium carbide powder are dispersed in an island form in a matrix having a two-phase structure of austenite and martensite in the iron-based sintered alloy.

In the aforementioned invention, the iron-based sintered alloy can be used as sliding components such as a die and a cutter blade.

In the iron-based sintered alloy according to the present invention, hard particles including titanium carbide, molybdenum carbide, and/or a composite carbide of titanium and molybdenum are dispersed in an island form in a matrix including a two-phase structure of austenite and martensite.

In the iron-based sintered alloy according to the present invention, the composition of the matrix is preferably a composition forming an austenite and martensite region in Schaeffler's diagram.

In the iron-based sintered alloy according to the present invention, maximum circle equivalent diameter of the hard particles is preferably 30 μm or less.

Advantages of the Invention

According to the present invention, there can be produced an iron-based sintered alloy in which the component of main hard particles is titanium carbide and which is used in a sliding component and is excellent in machinability, wear resistance, and corrosion resistance.

MODE FOR CARRYING OUT THE INVENTION

The following will describe modes for carrying out the present invention. The production method of the iron-based sintered alloy according to the present invention is a method for producing an iron-based sintered alloy, the method including: mixing a titanium carbide powder, a Cr powder, a Fe powder, a Mo powder, a Ni powder, a Co powder, and a powder of any one of Al, Ti, and Nb; and subjecting a resulting mixed powder containing, in terms of % by mass, titanium carbide: 20% to 35%, Cr: 3.0% to 12.0%, Mo: 3.0% to 8.0%, Ni: 8.0% to 23%, Co: 0.6% to 4.5%, and any one of Al, Ti or Nb: 0.6% to 1.0%, with the balance Fe, to cold isostatic pressing molding, vacuum sintering, and a solution treatment, to produce an iron based sintered alloy in which hard particles derived from the titanium carbide powder are dispersed in an island form in a matrix having a two-phase structure of austenite and martensite The present production method of the iron-based sintered alloy is suitably used as a production method of sliding components, particularly components such as a die and a cutter blade for a pelletizer of a resin extruder, which are processed from the same material.

Figure 1:
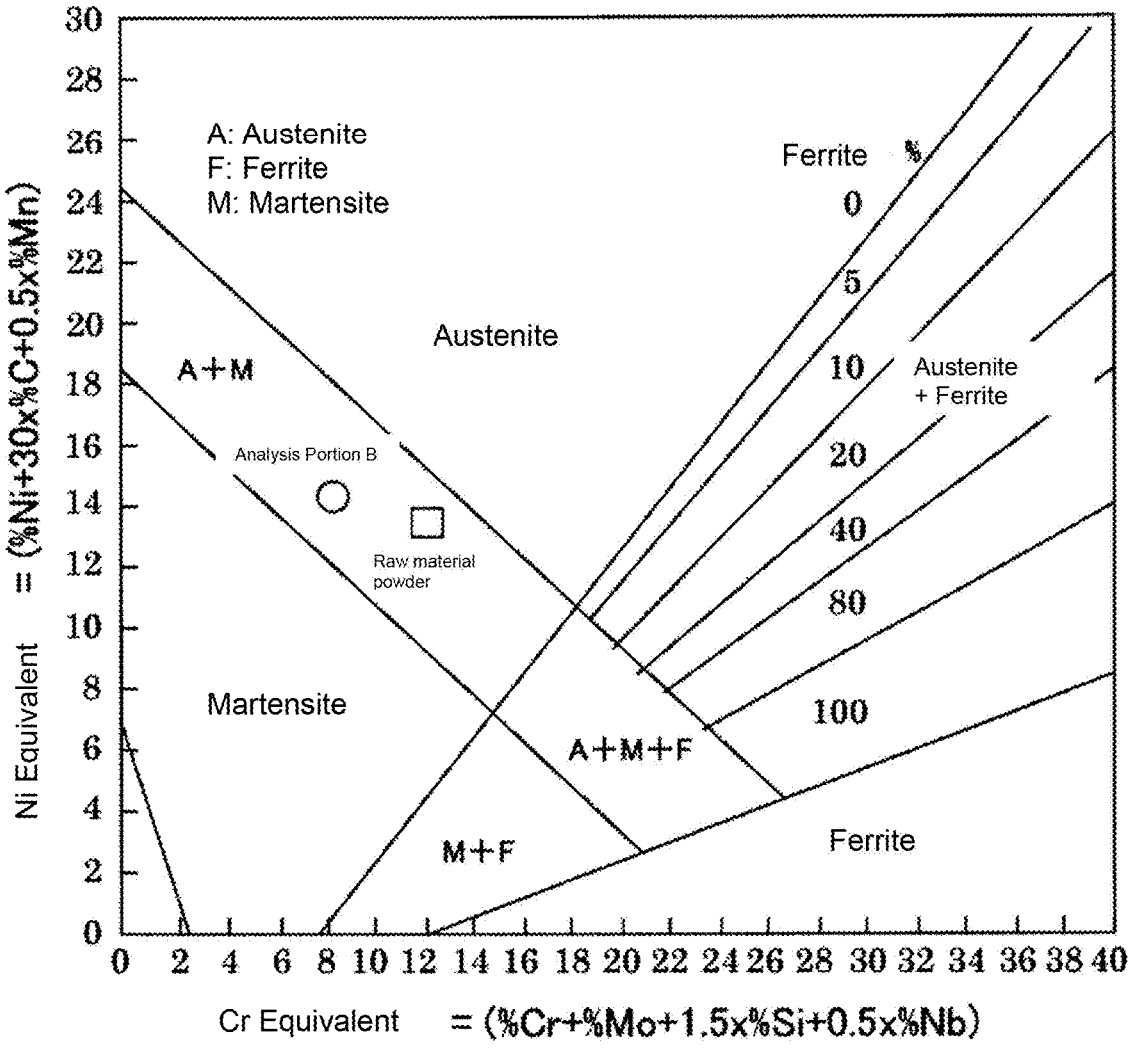
FIG. 1 is a Schaeffler's diagram.

In the production method of the iron-based sintered alloy according to the present invention, a Cr powder, a Mo powder, a Ni powder, a Co powder, a Fe powder and a powder of any one of Al, Ti, and Nb for forming a matrix and a titanium carbide powder for forming islands dispersed in the matrix are used and they are mixed to prepare a mixed powder. As for the composition of the mixed powder, the mass ratio of titanium carbide (TiC) is 20 to 35% and, as for Cr and the like, the mass ratios thereof are determined so that Cr equivalent and Ni equivalent belong to an austenite+martensite (A+M) region in Schaeffler's diagram. That is, the region is the region of (A+M) of the Schaeffler's diagram shown in FIG. 1. As shown in FIG. 1, the Cr equivalent is determined from the mass ratios of Cr, Mo, Si, and Nb and the Ni equivalent is determined from the mass ratios of Ni, C, and Mn. For the cold isostatic pressing molding, vacuum sintering, and solution treatment, known methods can be used.

Figure 2:
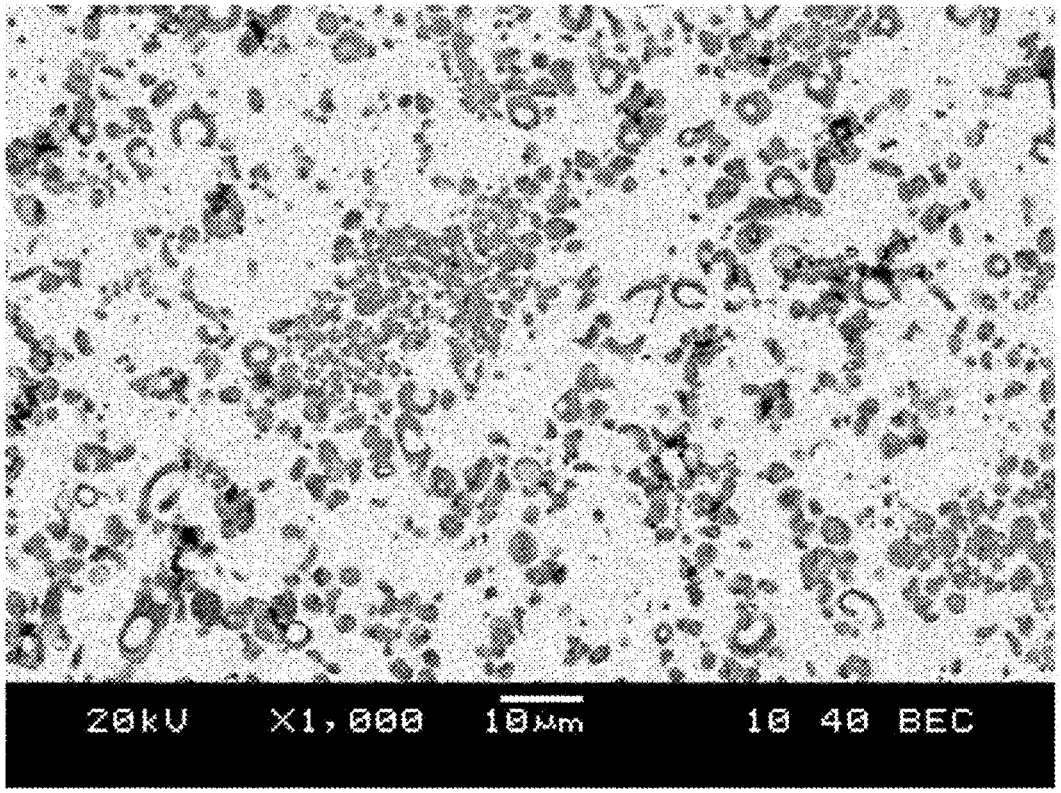
FIG. 2 is a scanning electron microscope (SEM) photograph showing a structure of an iron-based sintered alloy according to the present invention.

According to the present production method of the iron-based sintered alloy, there can be produced an iron-based sintered alloy in which hard particles including titanium carbide, molybdenum carbide, and/or a composite carbide of titanium and molybdenum are dispersed in an island form in a matrix including a two-phase structure of austenite+martensite. FIGS. 2 to 6 show examples of the iron-based sintered alloy according to the present invention. FIG. 2 is a scanning electron microscope (SEM) photograph showing a structure of an iron-based sintered alloy according to the present invention and it is observed that black fine hard particles are dispersed in an island form.

The hard particles have a size of 10 μm or less and are based on aggregates of a fine titanium carbide powder having a particle diameter of about 1 μm, which are used as a raw material of the aforementioned iron-based sintered alloy, or those formed by disintegration of the aggregates. According to the present iron-based sintered alloy, there can be produced those in which the area ratio of the hard particles is 30% to 40% and those having a maximum circle equivalent diameter thereof of 20 μm to 30 μm. Here, the maximum circle equivalent diameter means maximum sized one among projected area circle equivalent diameters.

Figure 3:
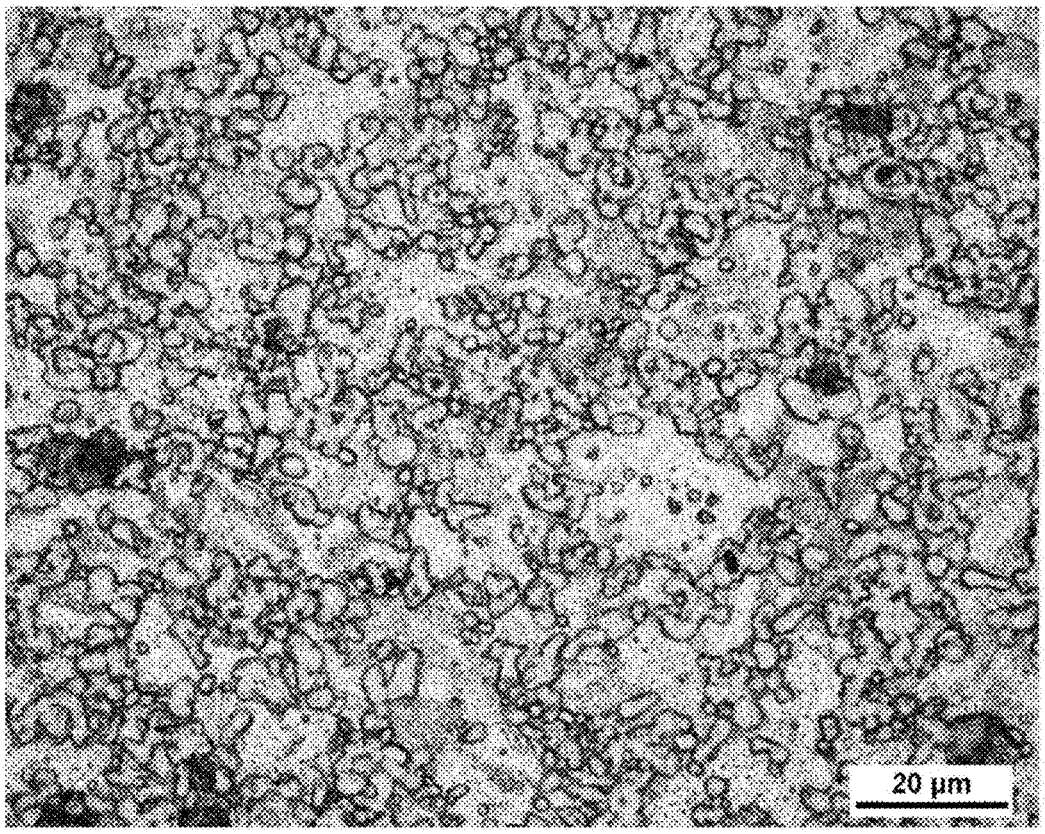
FIG. 3 is a photograph after etching of an iron-based sintered alloy according to the present invention.
Figure 4:
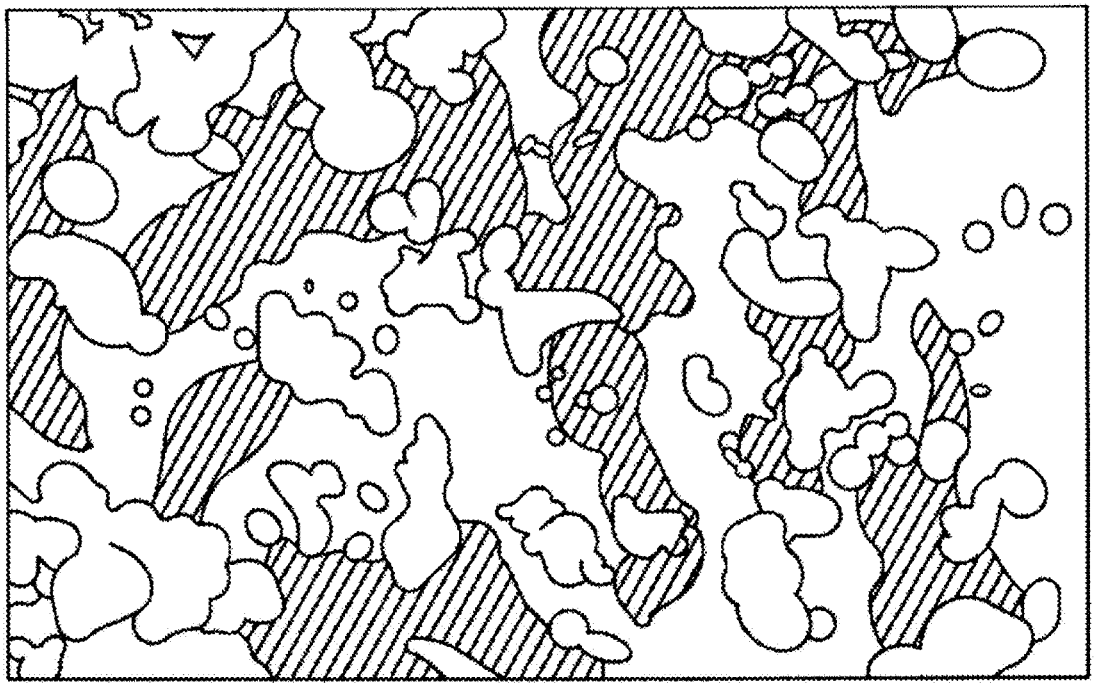
FIG. 4 is a schematic view in which a part of FIG. 3 is enlarged.

FIG. 3 shows a structure after etching of an iron-based sintered alloy according to the present invention. In the matrix, a dark portion in which etching has proceeded is a martensite phase and a white portion is an austenite phase. FIG. 4 is a schematic view in which a part of FIG. 3 is enlarged and shaded portion is a martensite phase and a white portion is an austenite phase. The proportion of the martensite phase to the austenite phase is observed to be about the same.

Figure 5:
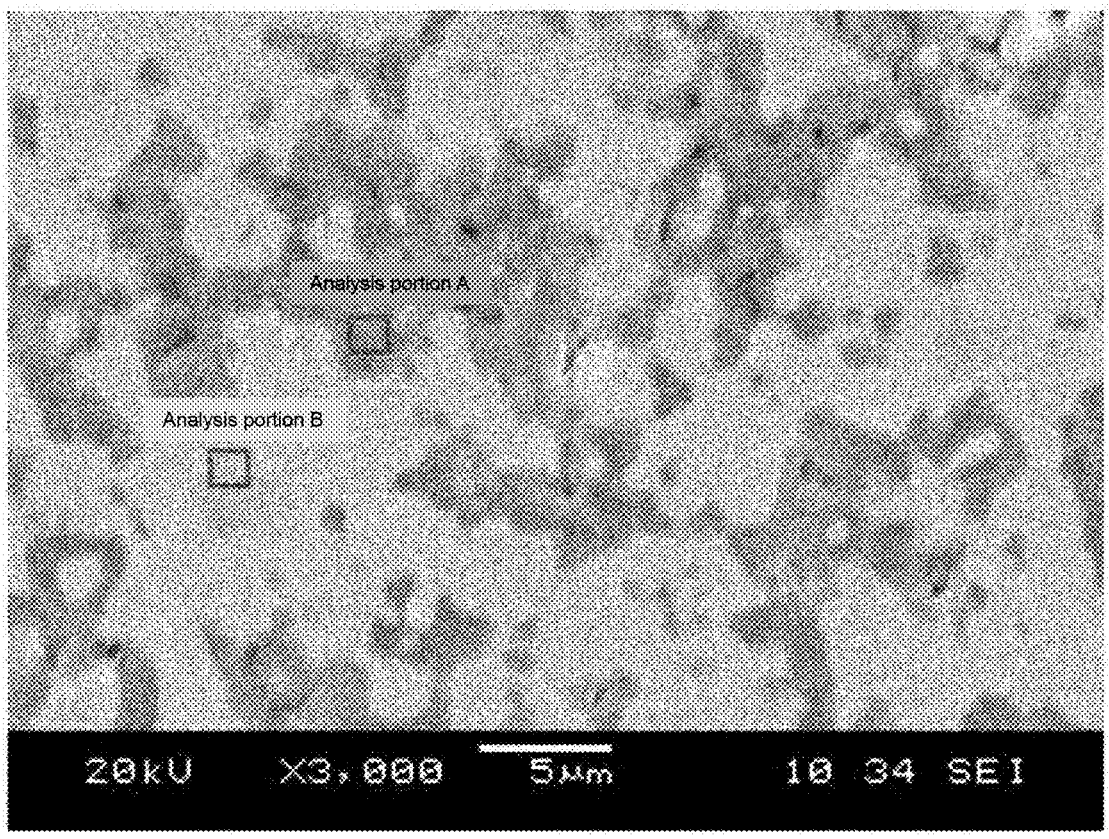
FIG. 5 is a SEM photograph showing a hard particle portion and a matrix portion of an iron-based sintered alloy according to the present invention, which are subjected to fluorescent X-ray analysis.
Figure 6:
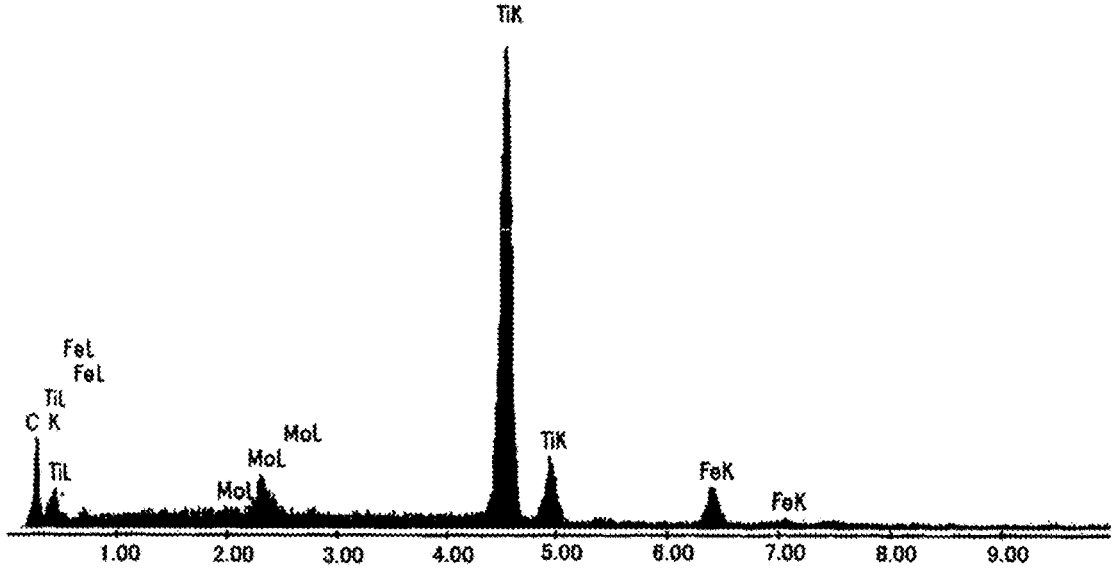
FIG. 6 are graphs showing analysis results of each portion shown in FIG. 5 by EDX.
Figure 6:
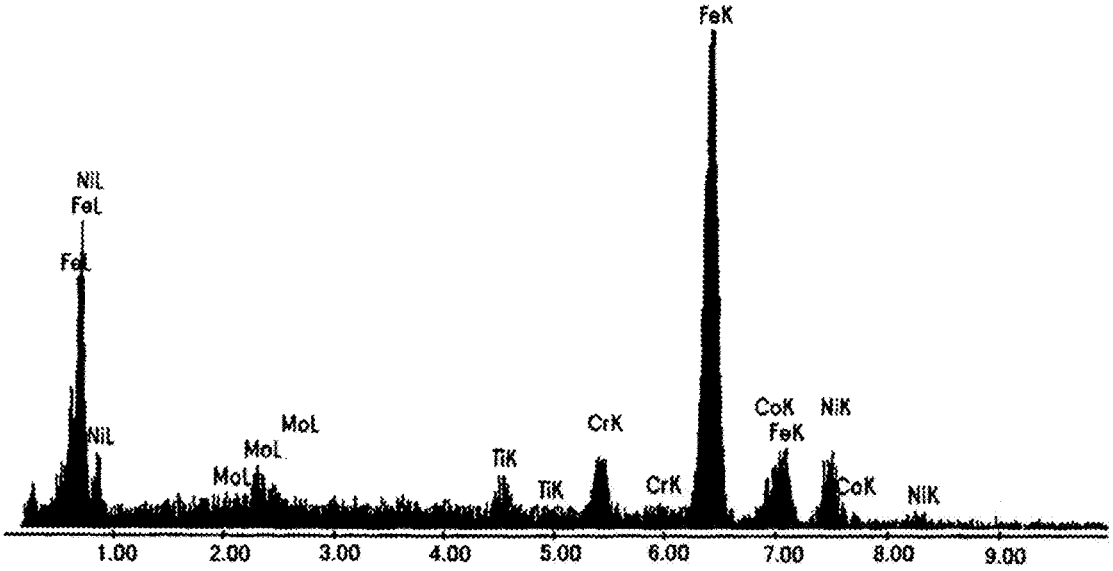

Although it is mentioned above that the hard particles dispersed in an island form are based on aggregates of the titanium carbide powder or those formed by disintegration thereof, results of performing component analysis of the hard particles and the matrix are shown in FIG. 5 and FIG. 6. FIG. 5 is a SEM photograph showing a hard particle portion (analysis portion A) and a matrix portion (analysis portion B) of an iron-based sintered alloy according to the present invention. FIG. 6 shows spectra of the analysis portion A (FIG. 6(*a*)) and the analysis portion B (FIG. 6(*b*)), which are analyzed by an energy dispersion-type fluorescent X-ray spectrometer (EDX) equipped on SEM, and the horizontal axis shows values with the unit of "key". According to FIG. 6(*a*), Ti, Mo, and C are detected from the hard particle portion. It is understood that Mo diffuses into TiC forming a nuclei of the hard particle to form molybdenum carbide and/or a composite carbide of titanium and molybdenum. Incidentally, Fe is present in the hard particle portion but the detail should be further analyzed.

According to FIG. 6(*b*), Fe, Cr, Ni, Mo, Co, and Ti are present in the matrix portion. Table 1 shows results of quantitative analysis of the components of the matrix portion (analysis portion B). Table 1 also describes mass ratios of raw material powders of the sample from which the present iron-based sintered alloy is prepared. The mass ratios of the raw material powders shown in Table 1 show mass ratios when the total of the raw material powders shown in Table 1 excluding the TiC powder among the raw material powders is regarded as 100%. Moreover, Table 1 describes Cr equivalent and Ni equivalent in Schaeffler's diagram, which are determined from the data described in Table 1. When the positions of the analysis portion B and the raw material powder in Schaeffler's diagram are determined from the Cr equivalent and the Ni equivalent, as shown in FIG. 1, they belong to the austenite+martensite (A+M) region.

TABLE 1

| | Chemical components (% by mass) | | | | | | Schaeffler's diagram | |
|---|---|---|---|---|---|---|---|---|
| | Cr | Ni | Mo | Ti | Co | Fe | Cr equivalent | Ni equivalent |
| Analysis portion B | 5.67 | 14.34 | 2.92 | 2.36 | 4.94 | 69.77 | 8.59 | 14.34 |
| Raw material powder | 5.48 | 13.84 | 6.85 | 0.75 | 3.97 | 69.11 | 12.33 | 13.84 |

According to Table 1, in the components Mo and Ti, a difference in mass ratio between the analysis portion B and the raw material powder is remarkable. It is understood that Mo diffuses into hard particles (TiC) diffuse in an island form to form molybdenum carbide and/or a composite carbide of titanium and molybdenum. On the other hand, it is understood that a part of TiC solid-solves in the matrix.

Example 1

An iron-based sintered alloy according to the present invention was manufactured and each test specimen was manufactured. Then, a measurement of Rockwell C scale hardness, a 3-point-bending transverse rupture test, a water immersion corrosion test, and a pin-on-disk-type friction wear test were performed. In the water immersion corrosion test, each test specimen was immersed in water at room temperature for 14 days and corrosion loss was measured. The pin-on-disk-type friction wear test was performed in water at room temperature under a contact face pressure of 12.7 kgf/cm$^2$ at a peripheral speed of 4.2 m/sec using a pin of Inventive Example or Comparative Example having an outer diameter of 8 mm and a height of 10 mm at the pin side and a disk including a commercially available carbide particle-dispersed material (55.4 HRC) having an outer diameter of 60 mm and a thickness of 5 mm at the disk side, and the test time was 1 hour. Incidentally, the above Comparative Example is an example of one based on an iron-based sintered alloy manufactured according to Examples described in Patent Document 1. The 3-point-bending transverse rupture test is based on JIS R1601.

A compounding powder of the powders shown in Table 2 were mixed in a ball mill, the resulting mixed powder was filled into a rubber mold having a space of ϕ100×50 and the rubber mold was sealed. Thereafter, a compact was molded by a CIP method. The resulting compact was heated under vacuum at 1,400° C. for 5 hours, thereby performing vacuum sintering. Then, after a solution treatment was performed, an aging treatment was conducted. Table 3 shows composition of the compounding powder of Comparative Example. In Table 3, numerals in parenthesis of TiC and $Mo_2C$ indicate % by mass of respective constituent elements.

TABLE 2

| | TiC | Ni | Cr | Mo | Co | Ti | Al | Fe |
|---|---|---|---|---|---|---|---|---|
| Inventive Example | 27.0 | 10.1 | 4.0 | 5.0 | 2.9 | 0.55 | — | balance |

TABLE 3

| | TiC (Ti, C) | $Mo_2C$ (Mo, C) | Ni | Cr | Co | Al | Fe |
|---|---|---|---|---|---|---|---|
| Comparative Example | 25 (20, 5) | 5 (4.7, 0.3) | 5.8 | 9.0 | 3.0 | 0.7 | balance |

Table 4 shows test results. The iron-based sintered alloy according to the present invention (Inventive Example) has slightly lower hardness and higher transverse rupture strength as compared to that of Comparative Example. In the results of the corrosion test, no difference is observed and Inventive Example is equal to Comparative Example. In the results of the friction wear test, wear loss of Inventive Example is one sixth (⅙) that of Comparative Example and wear loss of the counterpart disk in Inventive Example is also one half (½) that in Comparative Example. That is, the iron-based sintered alloy according to the present invention is more excellent in wear resistance than Comparative Example and also can prevent wear of the counterpart.

TABLE 4

| | Hardness | Transverse rupture strength | Corrosion loss in water immersion test | Wear loss in friction wear test (g) | |
|---|---|---|---|---|---|
| | (HRC) | (kgf/mm$^2$) | (g) | Pin side | Disk side |
| Inventive Example | 53.8 | 167 | 0 (no change in appearance) | 0.0167 | 0.0336 |
| Comparative Example | 58.2 | 147 | 0 (no change in appearance) | 0.1100 | 0.0660 |

While the invention has been described in detail and with reference to specific embodiments thereof, it will be apparent to one skilled in the art that various changes and modifications can be made therein without departing from the spirit and scope thereof. The present application is based on Japanese Patent Application No. 2016-100817 filed on May 19, 2016, and the contents thereof are incorporated herein by reference.

The invention claimed is:

1. A method for producing an iron-based sintered alloy, the method comprising:

mixing a titanium carbide powder, a Cr powder, a Mo powder, a Ni powder, a Co powder, a Fe powder and a powder of any one of Al, Ti, and Nb; and subjecting a resulting mixed powder containing, in terms of % by mass, titanium carbide: 20% to 35%, Cr: 3.0% to 12.0%, Mo: 3.0% to 8.0%, Ni: 8.0% to 23%, Co: 0.6% to 4.5%, and any one of Al, Ti or Nb: 0.6% to 1.0%, with the balance Fe, to cold isostatic pressing molding, vacuum sintering, and a solution treatment, to produce an iron-based sintered alloy in which hard particles derived from the titanium carbide powder are dispersed in an island form in a matrix having a two-phase structure of austenite and martensite.

2. The method for producing an iron-based sintered alloy according to claim 1, further comprising forming at least one of a die and a cutter blade as sliding components from the iron-based sintered alloy.

3. An iron-based sintered alloy, wherein hard particles comprising titanium carbide, molybdenum carbide, and/or a composite carbide of titanium and molybdenum are dispersed in an island form in a matrix having a two-phase structure of austenite and martensite, wherein the iron-based sintered alloy contains, in terms of % by mass, titanium carbide: 20% to 35%, Cr: 3.0% to 12.0%, Mo: 3.0% to 8.0%, Ni: 8.0% to 23%, Co: 0.6% to 4.5%, and any one of Al, Ti or Nb: 0.6% to 1.0%, with the balance Fe.

4. The iron-based sintered alloy according to claim 3, wherein the composition of the matrix is a composition forming an austenite and martensite region in Schaeffler's diagram.

5. The iron-based sintered alloy according to claim 3, wherein maximum circle equivalent diameter of the hard particles is 30 μm or less.

6. A die and a cutter blade as sliding components, at least one of which is comprised of the iron-based sintered alloy according to claim 3.

* * * * *